US011103078B2

(12) United States Patent
Morrison

(10) Patent No.: US 11,103,078 B2
(45) Date of Patent: Aug. 31, 2021

(54) BACK REST ASSEMBLY

(71) Applicant: Robert R. Morrison, Brampton (CA)

(72) Inventor: Robert R. Morrison, Brampton (CA)

(73) Assignee: Robert R. Morrison, Brampton (CA)

( * ) Notice: Subject to any disclaimer, the term of this patent is extended or adjusted under 35 U.S.C. 154(b) by 77 days.

(21) Appl. No.: 16/577,303

(22) Filed: Sep. 20, 2019

(65) Prior Publication Data

US 2020/0093278 A1 Mar. 26, 2020

Related U.S. Application Data

(60) Provisional application No. 62/733,847, filed on Sep. 20, 2018.

(51) Int. Cl.

| | |
|---|---|
| ***A47C 20/02*** | (2006.01) |
| ***A47C 20/04*** | (2006.01) |
| ***A47C 16/00*** | (2006.01) |
| ***A61G 7/10*** | (2006.01) |
| ***A61G 7/07*** | (2006.01) |
| ***A61G 7/065*** | (2006.01) |
| ***A47C 1/028*** | (2006.01) |
| ***A47C 20/00*** | (2006.01) |
| *A47C 1/16* | (2006.01) |

(52) U.S. Cl.

CPC ..... *A47C 20/027* (2013.01); *A47C 1/028* (2013.01); *A47C 16/00* (2013.01); *A47C 20/00* (2013.01); *A47C 20/02* (2013.01); *A47C 20/04* (2013.01); *A47C 20/041* (2013.01); *A47C 20/048* (2013.01); *A61G 7/065* (2013.01); *A61G 7/07* (2013.01); *A61G 7/1017* (2013.01); *A61G 7/1044* (2013.01); *A47C 1/16* (2013.01)

(58) Field of Classification Search

CPC ..... A47C 1/16; A47C 20/041; A47C 20/04; A47C 20/00; A47C 7/36; A47C 1/028; A47C 1/027; A47C 16/00; A47C 17/13; A47C 20/02; A47C 20/028; A47C 20/027; A47C 20/048; A61G 7/053; A61G 7/07; A61G 7/165; A61G 7/1044; A61G 7/1017; A47G 9/1009

See application file for complete search history.

(56) References Cited

U.S. PATENT DOCUMENTS

| | | | |
|---|---|---|---|
| 989,888 | A | 4/1911 | Adler |
| 1,356,613 | A | 10/1920 | Estes |
| 1,818,598 | A | 5/1929 | Berry |
| 2,250,026 | A | 7/1941 | Laukhuff |

(Continued)

FOREIGN PATENT DOCUMENTS

| | | | |
|---|---|---|---|
| GB | 2215996 | A | 10/1989 |
| WO | 9612427 | A1 | 5/1996 |

*Primary Examiner* — David R Hare
*Assistant Examiner* — Madison Emanski
(74) *Attorney, Agent, or Firm* — Bereskin & Parr LLP/S.E.N.C.R.L., S.R.L.

(57) ABSTRACT

A back rest assembly includes a base assembly mountable adjacent a resting surface and a back rest having a supported side pivotably supported by the base assembly and an unsupported side spaced laterally apart from the supported side along a lateral axis. When the base assembly is mounted, the back rest is positionable over the resting surface and selectively pivotable about the lateral axis for adjusting an angular position of the back rest relative to the resting surface.

20 Claims, 9 Drawing Sheets

(56) References Cited

U.S. PATENT DOCUMENTS

| | | | | |
|---|---|---|---|---|
| 2,788,529 | A | 4/1957 | Moritzacky et al. | |
| 3,931,653 | A | 1/1976 | Bien | |
| 4,853,990 | A | 8/1989 | Elder et al. | |
| 5,765,244 | A * | 6/1998 | Heidler | A47C 20/027 5/630 |
| 5,916,085 | A * | 6/1999 | Wells | A61G 7/053 5/608 |
| 5,937,459 | A | 8/1999 | Binaghi et al. | |
| 7,240,385 | B1 | 7/2007 | Brown | |
| 2012/0023669 | A1 | 2/2012 | Graller et al. | |

* cited by examiner

BACK REST ASSEMBLY

CROSS-REFERENCE TO RELATED APPLICATIONS

This application claims the benefit of U.S. Provisional Application No. 62/733,847, entitled "Back Rest Assembly" and filed on Sep. 20, 2018, which is incorporated herein by reference in its entirety.

FIELD

The specification relates generally to back rests, and more specifically, to adjustable back rest assemblies for a bed or other resting surface.

BACKGROUND

U.S. Pat. No. 5,765,244 (Heidler) discloses a generally u-shaped first structure comprising a first lateral member and two first legs. A generally u-shaped second structure comprises a second lateral member and two second legs. Two connecting legs are provided, each connecting leg being pivotally attached to one of the first legs and to one of the second legs, such that the first structure remains generally parallel to the second structure as the first structure is pivoted toward and away from the second structure. A generally u-shaped third structure comprises a third lateral member and two third legs. The two third legs of the third structure are pivotally attached to one of the second legs of the second structure. A pair of support members extend between the second legs of the second structure. Each of the support members has a plurality of spaced pins extending there-from. A pair of arms is provided, each of the arms having a first end pivotally attached to one of the third legs of the third structure. Each of the arms has a second end configured to receive one of the pins therein. Each of the arms is configured to extend between the third structure and a selected one of the pins, the third structure thus being supported at an adjustable angle from the second structure.

United Kingdom Patent No. 2,215,996 (Leppakorpi et al.) discloses a back rest including a first frame securable to a bed and a second frame pivotally connected to the first frame and presenting the backrest. A power means is arranged to produce the pivoting movement. One end of the power means is pivotally connected to one of the frames, whereas its opposite end is pivotally connected to the second frame or to the bed. One end of the power means is also pivotally connected to one end or a rigid link, the other end of which is rigidly connected to the second frame at its pivot centre in common with the frame. The link may be disconnected and frame pivoted until it is parallel with frame where upon reassembly of the link allows the back rest to be used on the opposite side of the bed.

U.S. Pat. No. 1,818,598 (Berry) discloses an apparatus adaptable for use on bedsteads and cots to raise or lower by mechanical means the head and upper-body portion of a person lying thereon.

U.S. Pat. No. 989,888 (Adler) discloses a removable frame having standards and a hinged supplemental frame pivoted thereto, so as to allow the hair mattress to extend directly through beneath the hinged frame, whereby, the latter may be tilted upwardly or dropped upon the mattress.

SUMMARY

The following summary is intended to introduce the reader to various aspects of the applicant's teaching, but not to define any invention.

According to some aspects, a back rest assembly is mountable to a bed having a horizontal resting surface extending laterally between a bed first side and a bed second side of the bed. The back rest assembly includes: (a) a base positionable underneath the resting surface for stabilizing the back rest assembly. The base extends laterally between a base first side for positioning on the bed first side and a base second side spaced apart from the base first side in a lateral direction. The base second side is for positioning toward the bed second side. The back rest assembly further includes (b) a riser supported by the base on the base first side and extending upwardly relative to the base. The riser is positioned laterally outboard of the resting surface on the bed first side when the base is underneath the resting surface. The back rest assembly further includes (c) a back rest spaced vertically above the base. The back rest has a supported side laterally adjacent to and pivotably supported by the riser and an unsupported side spaced laterally apart from the supported side in the lateral direction toward the base second side. When the base is underneath the resting surface, the back rest is positioned over the resting surface and is pivotable about a lateral first axis fixed relative to the riser between a horizontal position in which the back rest is oriented generally horizontally, and at least one inclined position in which the back rest is inclined relative to the resting surface for supporting a user's back.

In some examples, the back rest assembly is free of any load-bearing connection between the base and the unsupported side of the back rest.

In some examples, the back rest is spaced apart from the base by a back rest height when in the horizontal position, and the riser includes an adjustment mechanism for selectively raising and lowering the back rest relative to the base to adjust the back rest height.

In some examples, the riser comprises a post extending along a vertical axis and coupled to the base via the height-adjustment mechanism, and wherein the back rest is carried by the post and the height-adjustment mechanism is configurable between a locked configuration in which the post is vertically fixed relative to the base and an adjustment configuration in which the post is vertically translatable relative to the base for raising and lowering the back rest to adjust the back rest height.

In some examples, the back rest assembly further includes an actuator supported by the riser and operable to urge the back rest from the horizontal position toward the inclined position.

In some examples, the actuator includes a linear actuator having an actuator first portion coupled to the riser and an actuator second portion coupled to the back rest and translatable relative to the actuator first portion from a first position toward a second position for urging the back rest from the horizontal position toward the inclined position.

In some examples, the back rest is pivotably supported by the riser via a pivot bracket. The pivot bracket is pivotably connected to the riser for pivoting about the first axis and the back rest is mounted to the pivot bracket. The pivot bracket has an actuator connection portion spaced transversely apart from the first axis and connected to the actuator. The actuator is operable to urge the pivot bracket to pivot about the first axis in a forward direction for moving the back rest toward the inclined position and in a rearward direction circumferentially opposite the forward direction for moving the back rest toward the horizontal position.

In some examples, the back rest is pivotably mounted to the pivot bracket, and the pivot bracket includes a platform for engagement with an underside surface of the supported side of the back rest to limit pivoting of the backrest in the rearward direction, and wherein the back rest is free to pivot away from the platform in the forward direction.

In some examples, the back rest is pivotably mounted to the pivot bracket for pivoting about a lateral second axis fixed relative to the pivot bracket, the second axis parallel to and spaced apart from the first axis.

In some examples, the back rest assembly is configurable between a first side configuration for mounting the back rest assembly on the bed first side and a second configuration for mounting the back rest assembly on the bed second side, wherein when the back rest assembly is in the first side configuration, the base is positionable underneath the resting surface with the riser supporting the back rest on the bed first side and with the back rest overlying the resting surface and movable away from a head end of the bed when urged by the actuator to pivot toward the inclined position, and when the back rest assembly is in the second side configuration, the base is positionable underneath the resting surface with the riser supporting the back rest on the bed second side and with the back rest overlying the resting surface and movable away from the head end of the bed when urged by the actuator to pivot toward the inclined position.

According to some aspects, a back rest assembly includes: (a) a base for positioning underneath a resting surface; (b) a riser supported by and extending upwardly relative to the base, the riser for positioning laterally outboard of the resting surface when the base is underneath the resting surface; and (c) a back rest spaced vertically above the base. The back rest has a supported side pivotably supported by the riser and an unsupported side spaced laterally apart from the supported side along a lateral axis. When the base is underneath the resting surface, the back rest is positioned over the resting surface and pivotable about the lateral axis between a first position in which the back rest lies atop the resting surface, and at least one second position in which the back rest is inclined relative to the resting surface for supporting a user's back.

According to some aspects, a back rest assembly includes (a) a base assembly mountable adjacent a resting surface; and (b) a back rest having a supported side pivotably supported by the base assembly and an unsupported side spaced laterally apart from the supported side along a lateral axis, and when the base assembly is mounted, the back rest is positionable over the resting surface and selectively pivotable about the lateral axis for adjusting an angular position of the back rest relative to the resting surface.

In some examples, the base assembly includes a base positionable underneath the resting surface for mounting the base assembly adjacent the resting surface, and a riser supported by and extending upwardly relative to the base, the riser positionable laterally outboard of the resting surface when the base is underneath the resting surface, and the riser pivotably supporting the supported side of the back rest.

In some examples, the base assembly includes a base having a clamp mechanism for clamping the base assembly to a frame supporting the resting surface.

In some examples, the back rest assembly is free of any load-bearing connection between the base assembly and the unsupported side of the back rest.

In some examples, the base assembly comprises a height adjustment mechanism for selectively raising and lowering the back rest relative to the resting surface when the base assembly is mounted.

In some examples, the back rest assembly further includes an actuator supported by the base assembly and operable to urge pivoting of the back rest about the lateral axis.

In some examples, the back rest assembly further includes a stop surface limiting pivoting of the backrest in a rearward direction to a stop position. The back rest is free to pivot away from the stop surface in a forward direction opposite the rearward direction, and the stop surface is selectively movable to adjust the stop position.

In some examples, the back rest includes a frame having a supported first side member on the supported side and pivotably supported by the base assembly, an unsupported second side member on the unsupported side and extending generally parallel with the first side member, and a cross member extending laterally between and joining the first and second side members. Each of the first side member and the second side member extends between a proximal end adjacent the lateral axis and a distal end spaced apart from the proximal end away from the lateral axis. The cross member extends laterally between and joins the distal ends of the first and second side members, and the back rest assembly is free of any rigid cross members extending between the first and second side members adjacent the proximal ends.

BRIEF DESCRIPTION OF THE DRAWINGS

The drawings included herewith are for illustrating various examples of articles, methods, and apparatuses of the present specification and are not intended to limit the scope of what is taught in any way. In the drawings.

DETAILED DESCRIPTION

Various apparatuses or processes will be described below to provide an example of an embodiment of each claimed invention. No embodiment described below limits any claimed invention and any claimed invention may cover processes or apparatuses that differ from those described below. The claimed inventions are not limited to apparatuses or processes having all of the features of any one apparatus or process described below or to features common to multiple or all of the apparatuses described below. It is possible that an apparatus or process described below is not an embodiment of any claimed invention. Any invention disclosed in an apparatus or process described below that is not claimed in this document may be the subject matter of another protective instrument, for example, a continuing patent application, and the applicants, inventors or owners do not intend to abandon, disclaim, or dedicate to the public any such invention by its disclosure in this document.

Figure 1A:
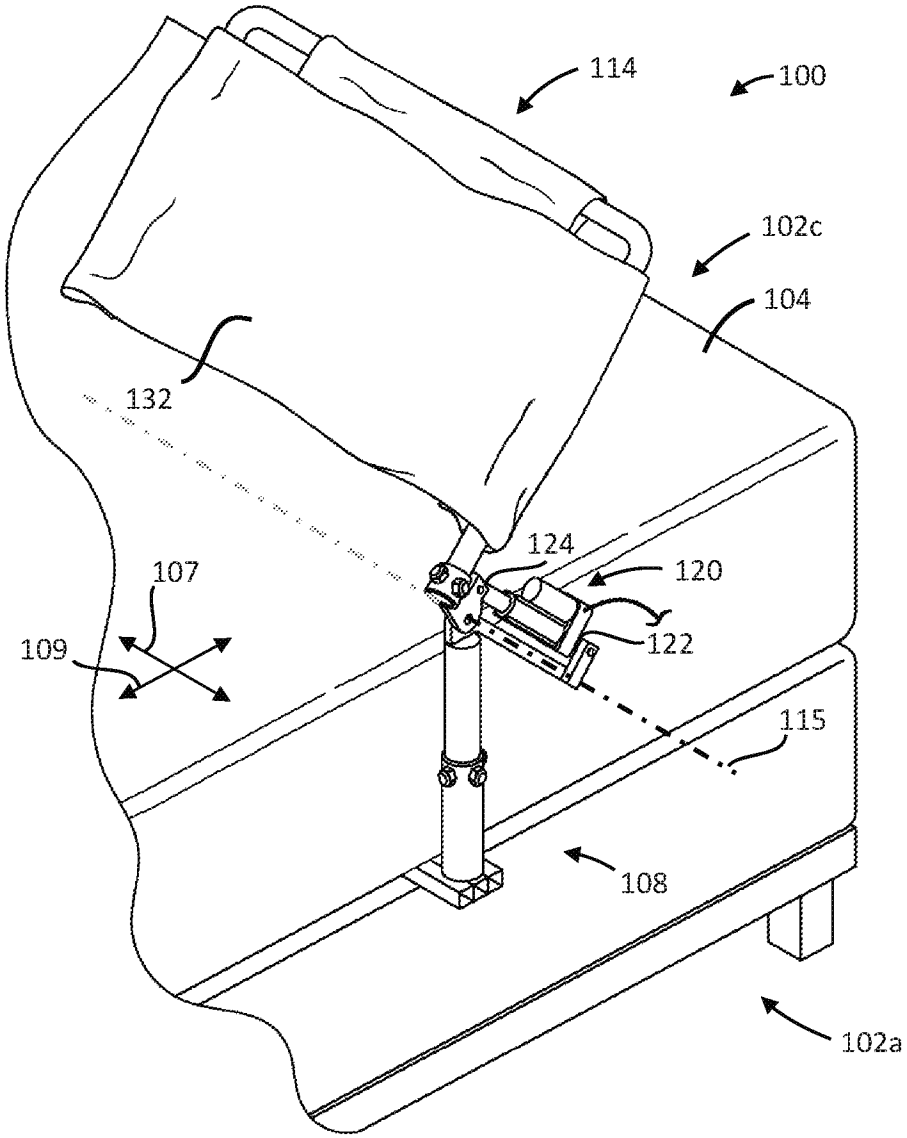
FIG. 1A is a perspective view of an example back rest assembly mounted on a first side of a bed, with the back rest assembly in an inclined configuration.
Figure 2:
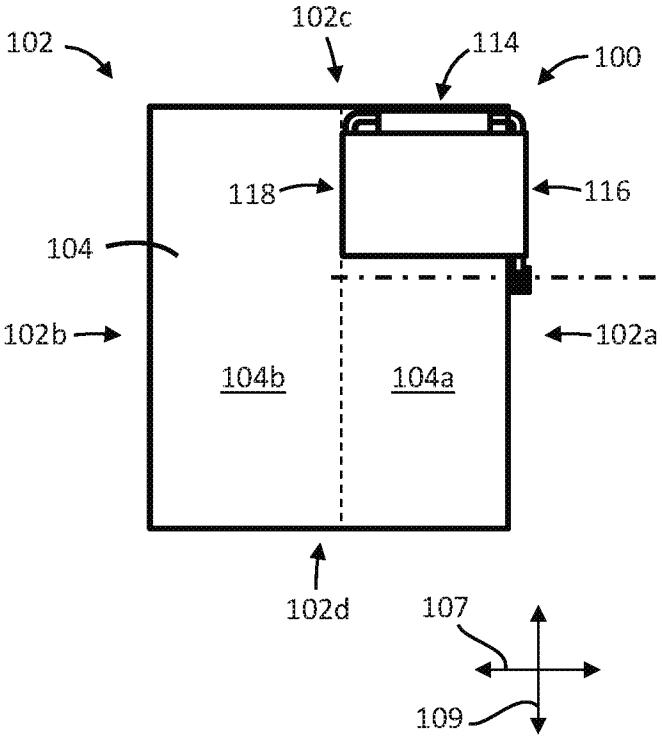
FIG. 2 is a schematic plan view of the back rest assembly and bed of FIG. 1A, with the back rest assembly in the horizontal configuration.
Figure 1B:
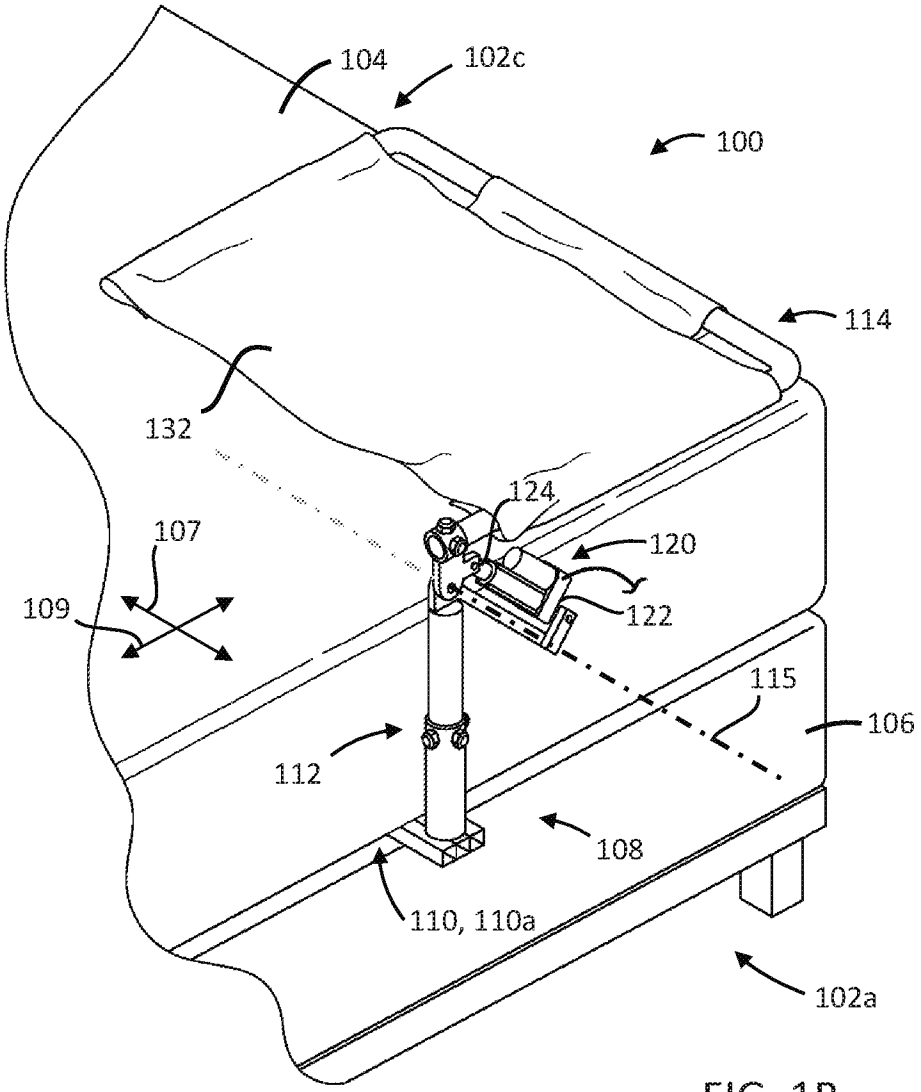
FIG. 1B is a perspective view like that of FIG. 1A, but with the back rest assembly in a horizontal configuration.

Referring to FIG. 1A, an example back rest assembly 100 mounted to a bed 102 is shown. Referring to FIG. 2, in the example illustrated, the bed 102 includes a resting surface 104 extending laterally between a bed first side 102*a* and a bed second side 102*b* of the bed 102, and axially between a bed head end 102*c* and a bed foot end 102*d* of the bed 102. In the example illustrated, the resting surface 104 is oriented generally horizontally. In the example illustrated, the back rest assembly 100 is mounted on the bed first side 102*a* of the bed 102. Referring to FIG. 1B, in the example illustrated, the resting surface 104 comprises a mattress. The mattress can include, for example, a coil spring mattress, a foam mattress, a futon mattress, or the like. The bed 102 further includes an optional bed base 106 supporting the resting surface 104 above the ground. The bed base 106 can include, for example, a box spring, a bed frame, a slat platform, or the like.

Figure 3:
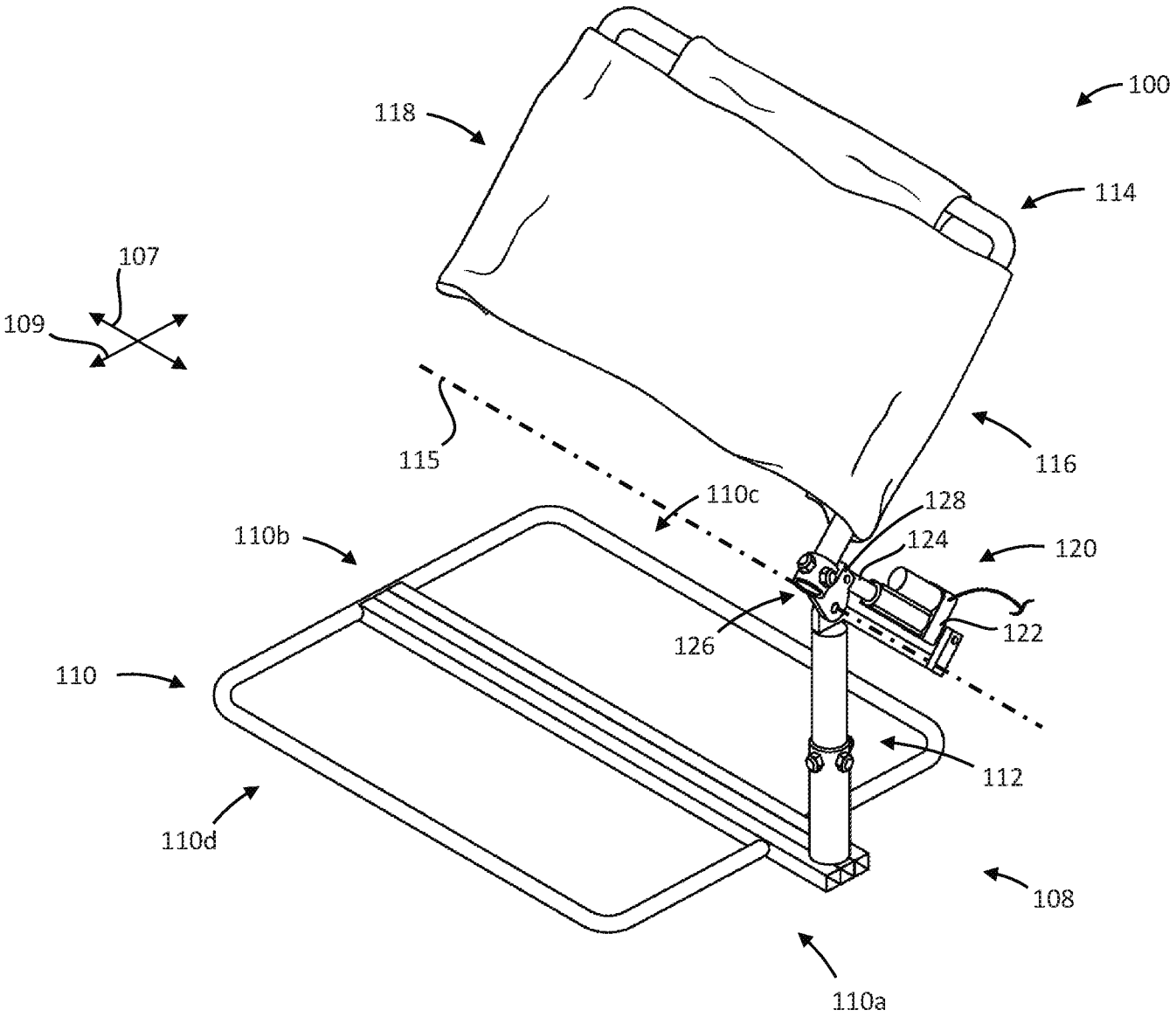
FIG. 3 is a perspective view of the back rest assembly of FIG. 1A in isolation of the bed.

Referring to FIG. 3, in the example illustrated, the back rest assembly 100 includes a base assembly 108 mountable adjacent the resting surface 104. In the example illustrated, the base assembly 108 includes a base 110 for positioning underneath the resting surface 104 (FIG. 1B) for stabilizing the back rest assembly 100 (and mounting the base assembly 108 adjacent the resting surface 104). In the example illustrated, the base 110 lies in a generally horizontal plane. Referring to FIG. 1B, in the example illustrated, the base 110 is positioned vertically intermediate, and is sandwiched between, the resting surface and the bed base 106. In some examples, the base 110 can be positioned underneath the resting surface 104 on, for example, a ground surface. In some examples, the base 110 may be anchored to help further stabilize the back rest assembly 100.

Referring to FIG. 3, in the example illustrated, the base 110 extends laterally between a base first side 110*a* for positioning on the bed first side 102*a* (FIG. 2) and a base second side 110*b* spaced apart from the base first side 110*a* in a lateral direction 107. In the example illustrated, the base second side 110*b* is for positioning toward the bed second side 102*b* (FIG. 2). In the example illustrated, the base 110 extends axially between a base third side 110*c* for positioning toward the bed head end 102*c* (FIG. 2) and a base fourth side 110*d* spaced apart from the base third side 110*c* in an axial direction 109 for positioning toward the bed foot end 102*d* (FIG. 2).

In the example illustrated, the base assembly 108 includes a riser 112 supported by the base 110 on the base first side 110*a* and extending upwardly relative to the base 110. In the example illustrated, the riser 112 extends upwardly relative to the base 110 along a vertical riser axis 113 (FIG. 4). Referring to FIG. 1B, in the example illustrated, the riser 112 is positioned laterally outboard of the resting surface 104 on the bed first side 102*a* when the base 110 is positioned underneath the resting surface 104.

Still referring to FIG. 1B, in the example illustrated, the back rest assembly 100 includes a back rest 114 pivotably supported by the base assembly 108. In the examples illustrated, the back rest 114 is spaced vertically above the base 110 and pivotably supported by the riser 112. When the base 110 is positioned underneath the resting surface 104, the back rest 114 is positioned over the resting surface 104 and is selectively pivotable about a lateral first axis 115 for adjusting an angular position of the back rest 114 relative to the resting surface 104. In the example illustrated, the lateral first axis 115 is fixed relative to the riser 112 during normal operation, and the back rest 114 is selectively pivotable about the axis 115 between a first position (an example of which is shown in FIG. 1B) and at least one second position (an example of which is shown in FIG. 1A). In the example illustrated, the lateral first axis 115 extends in the lateral direction 107. When in the first position (also referred to as a horizontal position with respect to the example shown in FIGS. 1-6), the back rest 114 lies atop the resting surface for allowing a user to rest on the resting surface 104 atop the back rest 114. In the example illustrated, the back rest 114 is oriented generally horizontally when in the horizontal position. Referring to FIG. 1A, when in the second position (also referred to as an inclined position with respect to the example shown in FIGS. 1-6), the back rest 114 is inclined relative to the resting surface 104 (and the first position) for supporting a user's back at an inclined angle relative to the resting surface 104 (and the first position).

Referring to FIG. 3, in the example illustrated, the back rest 114 has a supported side 116 pivotably supported by the base assembly 108, and an unsupported side 118 spaced laterally apart from the supported side 116 along the lateral axis 115. In the example illustrated the supported side 116 is laterally adjacent to and pivotably supported by the riser 112, and the unsupported side 118 is spaced laterally apart from the supported side 116 in the lateral direction 107 toward the base second side 110*b*. In the example illustrated, the unsupported side 118 of the back rest 114 overlies the resting surface 104 when the base is positioned under the resting surface (see e.g. FIG. 1A), and the back rest assembly 100 is free of any load-bearing connection between the base assembly 108 (or the base 110) and the unsupported side 118. This can facilitate, for example, convenient mounting of the back rest assembly 100 from one side (e.g. the bed first side 102*a*) of the bed 102. Referring to FIG. 2, this can also help allow for the back rest 114 to extend laterally over only a first portion 104*a* of the resting surface 104, so that a second portion 104*b* of the resting surface 104 can be clear of the back rest 114 for use by, for example, a spouse or partner who may wish to rest on the resting surface 104 without utilizing the back rest assembly 100.

Referring to FIG. 3, in the example illustrated, the back rest assembly 100 further includes an actuator 120 operable to urge pivoting of the back rest 114 (e.g. from the horizontal position toward the inclined position). In the example illustrated, the actuator 120 is supported by the riser 112. In the example illustrated, the actuator 120 comprises a linear actuator having an actuator first portion 122 coupled to the riser 112 and an actuator second portion 124 coupled to the back rest 114 and translatable relative to the actuator first portion 122 from a first position (shown in FIG. 1B) toward a second position (shown in FIG. 1A) for urging the back rest 114 from the horizontal position toward the inclined position. In the example illustrated, the actuator first portion 122 comprises an actuator housing, and the actuator second portion 124 comprises an actuator rod movably received in the housing for translating between the first and second positions. In the example illustrated, the actuator 120 is electric and energizable to translate the actuator second portion 124 between the first and second positions (and urge pivoting of the back rest 114).

Still referring to FIG. 3, in the example illustrated, the back rest 114 is pivotably supported by the riser 112 via a pivot bracket 126. In the example illustrated, the pivot bracket 126 is pivotably connected to the riser 112 for pivoting about the first axis 115, and the back rest 114 is secured to the pivot bracket 126 for pivoting therewith. In the example illustrated, the pivot bracket 126 is pivotably connected to the riser 112 via a pivot joint at the first axis 115. In the example illustrated, the pivot joint is configured to permit pivoting of the back rest 114 about the first axis 115 and to generally inhibit tilting of the back rest 114 relative to the base assembly 108 about a horizontal axis perpendicular to the first axis 115. In the example illustrated, the pivot joint comprises a bolt extending along the first axis 115 through bolt apertures in the pivot bracket 126 and a complementary mounting bracket of the riser 112 (see also FIG. 9).

In the example illustrated, the actuator 120 is operable to urge the pivot bracket 126 to pivot about the first axis 115 in a forward direction for moving the back rest 114 toward the inclined position and in a rearward direction circumferentially opposite the forward direction for moving the back rest 114 toward the horizontal position. In the example illustrated, the pivot bracket 126 includes an actuator connection portion 128 spaced transversely apart from the first axis 115. In the example illustrated, the actuator second portion 124 is connected to the actuator connection portion 128 of the pivot bracket 126 via a pivot joint, and is coupled to the back rest 114 via the pivot bracket 126.

Referring to FIG. 4, in the example illustrated, the back rest 114 includes a back rest frame 130 having a generally inverted-U shape, and a back support surface 132 attached to and extending laterally across the frame 130 for supporting a user's back. In the example illustrated, the back support surface 132 comprises a flexible sheet extending laterally across the frame 130. Referring to FIG. 1B, when the back rest 114 is in the horizontal position, the back support surface 132 can conform to the resting surface 104 of the bed 102 to allow a user to rest horizontally atop the back support surface 132 (and the resting surface 104 below the back support surface 132). Referring to FIG. 1A, when the back rest 114 is in the inclined position, the back support surface 132 is inclined relative to the resting surface 104 to help support a user's back at an inclined angle relative to the resting surface 104.

Referring to FIG. 4, in the example illustrated, the frame 130 includes a supported first side member 134 on the supported side 116 of the back rest 114. In the example illustrated, the first side member 134 extends along a first side member axis 136 perpendicular to the first axis 115, and is mounted to the pivot bracket 126. In some examples, the first side member 134 may be pivotably mounted directly to the riser 112 (in which case the pivot bracket 126 may be omitted). In the example illustrated, the frame 130 further includes an unsupported second side member 138 on the unsupported side 118 of the back rest 114 and extending parallel with the first side member 134, and a cross member 140 extending laterally between and joining the first and second side members 134, 138. In the example illustrated, each of the first side member 134 and the second side member 138 extends between a proximal end 142 adjacent the first axis 115 and a distal end 144 spaced apart from the proximal end 142 away from the first axis 115. The cross member 140 extends laterally between and joins the distal ends 144 of the first and second side members 134, 138. In the example illustrated, the frame 130 (and the back rest assembly) is free of any other cross members extending between the first and second side members 134, 138, and in particular, the frame 130 is free of any cross members extending between the first and second side members 134, 138 adjacent the proximal ends 142. This can help provide for increased comfort when the back rest 114 is in the first (horizontal) position. In the example illustrated, the back support surface 132 extends laterally across the frame 130 from the first side member 134 to the second side member 138.

Figure 5B:
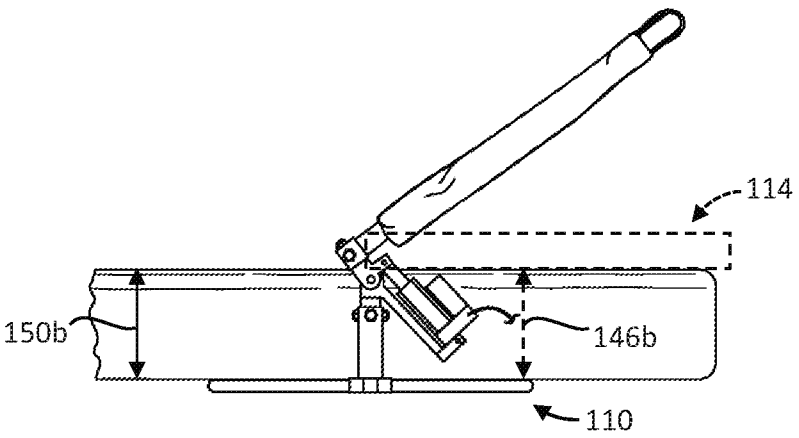
FIG. 5B is an elevation view of the back rest assembly of FIG. 1A, with the back rest assembly in a lowered configuration.
Figure 5A:
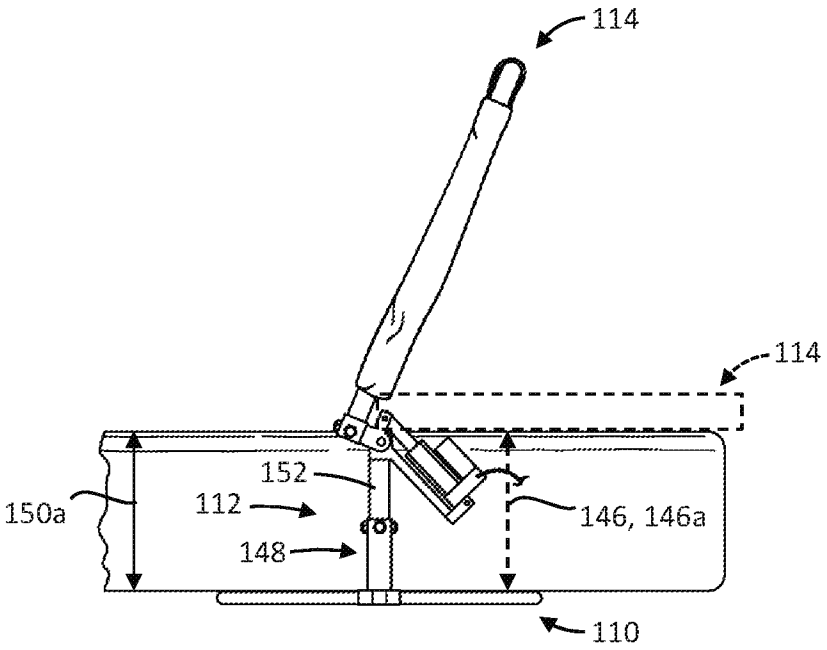
FIG. 5A is an elevation view of the back rest assembly of FIG. 1A, with the back rest assembly in a raised configuration.

Referring to FIG. 5A, when in the horizontal position (shown schematically in dashed lines in FIGS. 5A and 5B), the back rest 114 is spaced apart from the base 110 by a back rest height 146. In the example illustrated, the riser 112 includes a first adjustment mechanism 148 for selectively raising and lowering the back rest 114 relative to the base 110 to adjust the back rest height 146. As shown in FIGS. 5A and 5B, this can facilitate adjustment of the back rest assembly 100 to accommodate mounting of the back rest assembly 100 to beds having different vertical dimensions. For example, referring to FIG. 5A, the back rest 114 can be raised relative to the base 110 to a first back rest height 146*a* corresponding to a first mattress thickness 150*a* for mounting the back rest assembly 100 to a bed having the first mattress thickness 150*a*. Referring to FIG. 5B, the back rest 114 can be lowered relative to the base 110 to a second back rest height 146*b* that is less than the first back rest height 146*a* and corresponds to a second mattress thickness 150*b* that is less than the first mattress thickness 150*a*, for mounting the back rest assembly 100 to a bed having the second mattress thickness 150*b*.

Referring to FIG. 4, in the example illustrated, the riser 112 comprises a post 152 extending along the riser axis 113 and coupled to the base 110 via the first adjustment mechanism 148. In other examples, the riser may have a different configuration than that shown in the present figures. For example, in some examples, the riser may comprise a plurality of posts or other structure (or cross-sectional geometry) extending upwardly from the base, vertically or at an angle, for supporting the back rest 114.

In the example illustrated, the back rest 114 and the actuator 120 are supported (carried) by the post 152 and movable therewith. In the example illustrated, the first adjustment mechanism 148 is configurable between a first locked configuration in which the post 152 is vertically locked relative to the base 110, and a first adjustment configuration in which the post 152 is vertically translatable along the riser axis 113 relative to the base 110 for raising and lowering the back rest 114 (and the actuator 120) to adjust the back rest height 146 (FIG. 5A). In the example illustrated, the first adjustment mechanism 148 comprises a vertically oriented socket 149 fixed to the base 110 for receiving the post 152, and one or more fasteners 151 for selectively fixing the post 152 at a fixed vertical position in the socket 149.

In the example illustrated, the pivot bracket 126 is pivotably connected to the post 152, and the back rest 114 is supported by the post 152 via the pivot bracket 126. In the example illustrated, the riser 112 further includes an actuator mount 154 fixed to the post 152, and the actuator first portion 122 is coupled to the actuator mount 154 via a pivot joint.

In the example illustrated, the back rest assembly 100 is configurable between a first side configuration (shown in FIGS. 1A-5B) and a second side configuration (shown in FIG. 6) for mounting the back rest assembly 100 on the bed first side 102*a* and the bed second side 102*b*, respectively.

Figure 6:
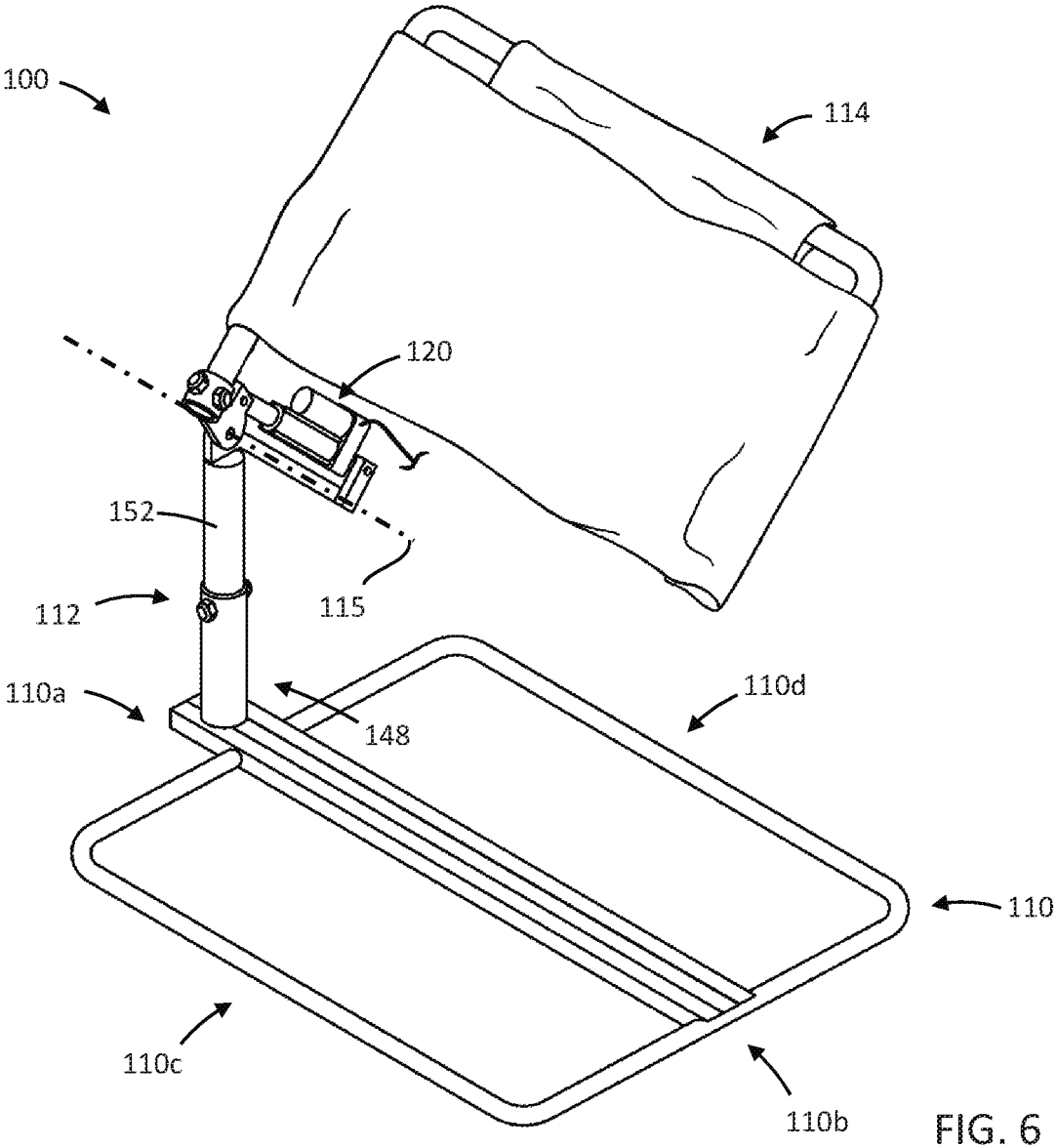
FIG. 6 is a perspective view of the back rest assembly of FIG. 1A, with the back rest assembly configured for mounting on a second side of the bed.

Referring to FIG. 1B, when the back rest assembly 100 is in the first side configuration, the base 110 is positionable underneath the resting surface 104 with the riser 112 supporting the back rest 114 on the bed first side 102*a*, and with the back rest 114 overlying the resting surface 104 and movable away from the bed head end 102*c* when urged by the actuator 120 to pivot toward the inclined position. Referring to FIG. 6, when the back rest assembly 100 is in the second side configuration, the base 110 is positionable underneath the resting surface 104 with the riser 112 supporting the back rest 114 on the bed second side 102*b*, and with the back rest 114 overlying the resting surface 104 and movable away from the bed head end 102*c* when urged by the actuator 120 to pivot toward the inclined position.

In the example illustrated, when the first adjustment mechanism 148 is in the unlocked configuration, the post 152, back rest 114, and actuator 120 are rotatable about the riser axis 113 (FIG. 4) for configuring the back rest assembly 100 between the first and second side configurations.

Figure 4A:
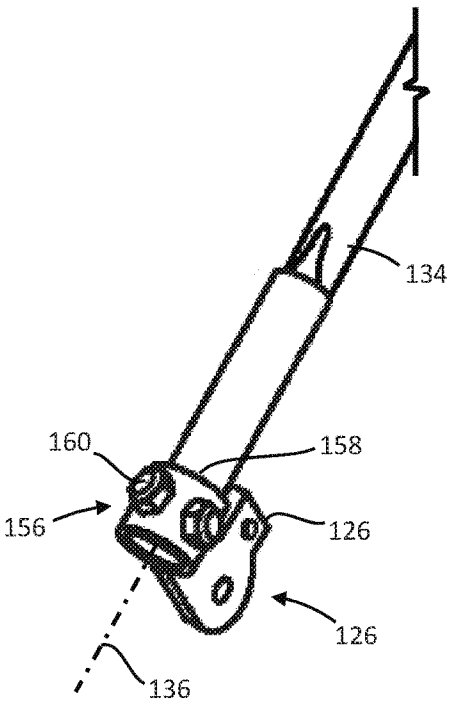
FIG. 4A is a close-up view of a portion of FIG. 4.
Figure 4:
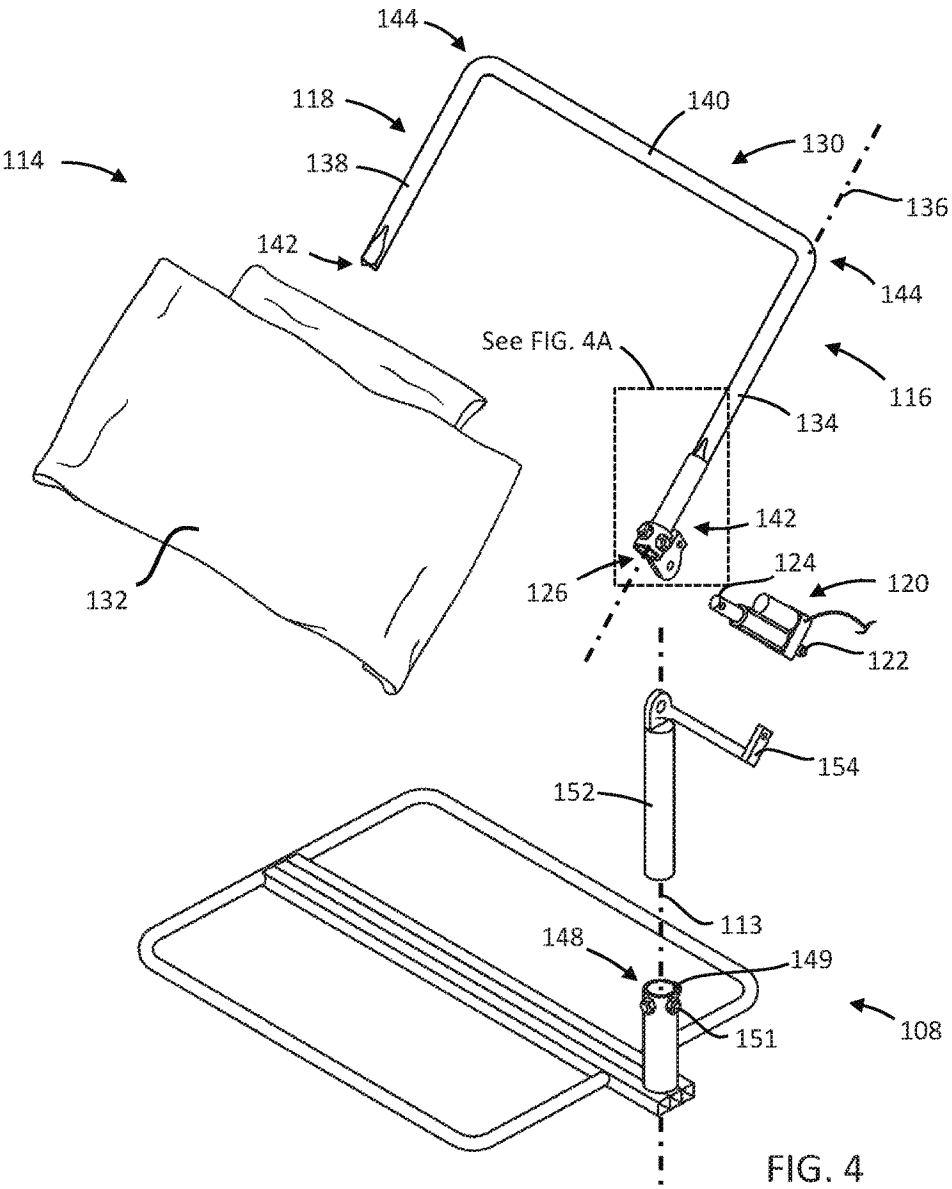
FIG. 4 is an exploded view of the back rest assembly of FIG. 1A.

Referring to FIGS. 4 and 4A, in the example illustrated, the back rest 114 is mounted to the pivot bracket 126 via a second adjustment mechanism 156. In the example illustrated, the second adjustment mechanism 156 is configurable between a second locked configuration in which the back rest 114 is locked relative to the pivot bracket 126, and a second adjustment configuration in which the back rest 114 is rotatable relative to the pivot bracket 126 about the first side member axis 136 for reconfiguring the back rest assembly 100 between the first and second side configurations. In the example illustrated, the second adjustment mechanism 156 comprises a second socket 158 fixed relative to the pivot bracket 126 for receiving the first side member 134, and one or more fasteners 160 for selectively fixing the first side member 134 (and the back rest 114) at a fixed position in the second socket 158.

In the example illustrated, the back rest assembly 100 is configurable from the first side configuration to the second side configuration by rotating the post 152, actuator 120, and back rest 114 180° degrees about the riser axis 113 relative to the base 110 when the first adjustment mechanism 148 is in the first adjustment configuration, and by rotating the back rest 180° degrees about the first side member axis 136 relative to the pivot bracket 126 when the second adjustment mechanism 159 is in the second adjustment configuration.

Figure 7B:
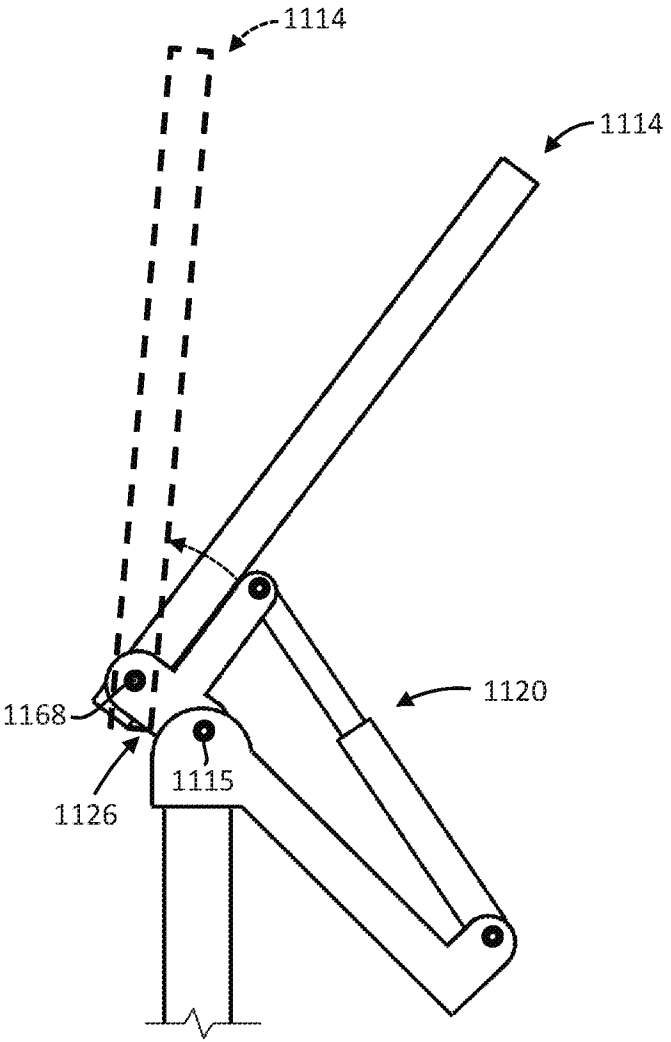
FIG. 7B is a schematic elevation view like that of FIG. 7, but with the back rest assembly in an inclined configuration.
Figure 7A:
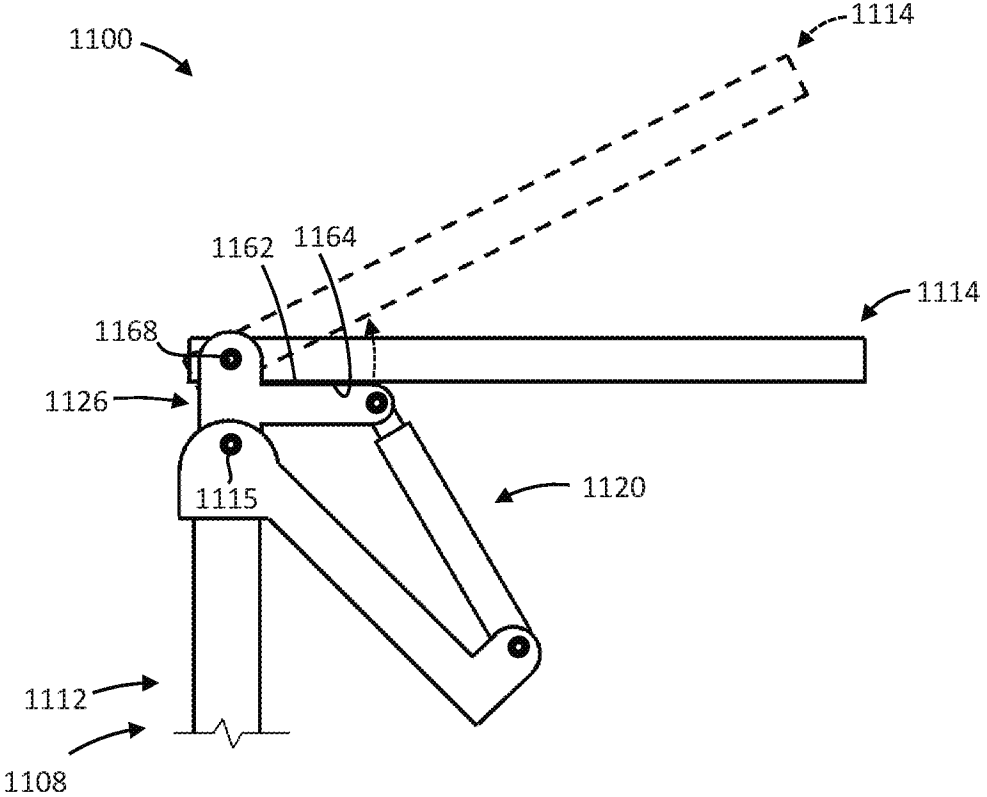
FIG. 7A is a schematic elevation view of a portion of another example back rest assembly, with the back rest assembly in a horizontal configuration.

Referring to FIGS. 7A and 7B, an upper portion of another example back rest assembly 1100 is shown schematically. The back rest assembly 1100 is similar to the back rest 114, and like features are identified with like reference characters, incremented by 1000.

In the example illustrated, the back rest assembly 1100 includes a base assembly 1108 (only an upper portion of which is shown in FIGS. 7A and 7B) including a base and a riser 1112 supported by and extending upwardly relative to the base, a back rest 1114 spaced vertically above the base and pivotably supported by the riser 1112 for pivoting about a lateral first axis 1115 (e.g. between horizontal and inclined positions), and an actuator 1120 operable to urge the back rest 1114 from the horizontal position toward the inclined position.

In the example illustrated, the back rest 1114 is pivotably supported by the riser 1112 via a pivot bracket 1126. In the example illustrated, the pivot bracket 1126 is pivotably connected to the riser 1112 for pivoting about the first axis 1115, and the back rest 1114 is mounted to the pivot bracket 1126. In the example illustrated, the actuator 1120 is operable to urge the pivot bracket 1126 to pivot about the first axis 1115 in a forward direction for moving the back rest 1114 toward the inclined position and in a rearward direction circumferentially opposite the forward direction for moving the back rest 1114 toward the horizontal position.

In the example illustrated, the back rest assembly 1100 includes a stop surface (in the form of a platform 1162) for limiting pivoting of the backrest 1114 in a rearward direction to a stop position. In the example illustrated, the back rest 1114 is free to pivot away from the stop surface in a forward direction opposite the rearward direction, and the stop surface is selectively movable to adjust the stop position. In the example illustrated, the back rest 1114 is pivotably mounted to the pivot bracket 1126, and the pivot bracket 1126 comprises the stop surface, in the form of the platform 1162 for engagement with an underside surface 1164 of the supported side of the back rest 1114 to limit pivoting of the back rest 1114 in the rearward direction. In the example illustrated, the actuator 1120 is operable to urge the platform 1162 to pivot about the first axis 1115 to adjust the stop position (e.g. in the forward direction to push the back rest 1114 toward the inclined position, and in the rearward direction for moving the back rest 1114 toward the horizontal position). In the example illustrated, the back rest 1114 is free to pivot away from the platform 1162 (stop surface) in the forward direction (as shown in dashed lines in FIGS. 7A and 7B). This can allow the back rest 1114 to be moved without operating the actuator 1120 to, for example, access an area under the back rest 1114. This may also help improve safety by, for example, allowing the back rest 1114 to yield to objects behind the back rest 1114 when the actuator 1120 is being operating for moving the back rest 1114 toward the horizontal position.

In the example illustrated, the back rest 1114 is pivotably connected to the pivot bracket 1126 for pivoting about a lateral second axis 1168 fixed relative to the pivot bracket 1126. In the example illustrated, the second axis 1168 is parallel to and spaced apart from the first axis 1115. In the example illustrated, the back rest 1114 is pivotably connected to the pivot bracket 1126 via a pivot joint at the second axis 1168. In some examples, the first and second axes 1115, 1168 can be coaxial.

Figure 8:
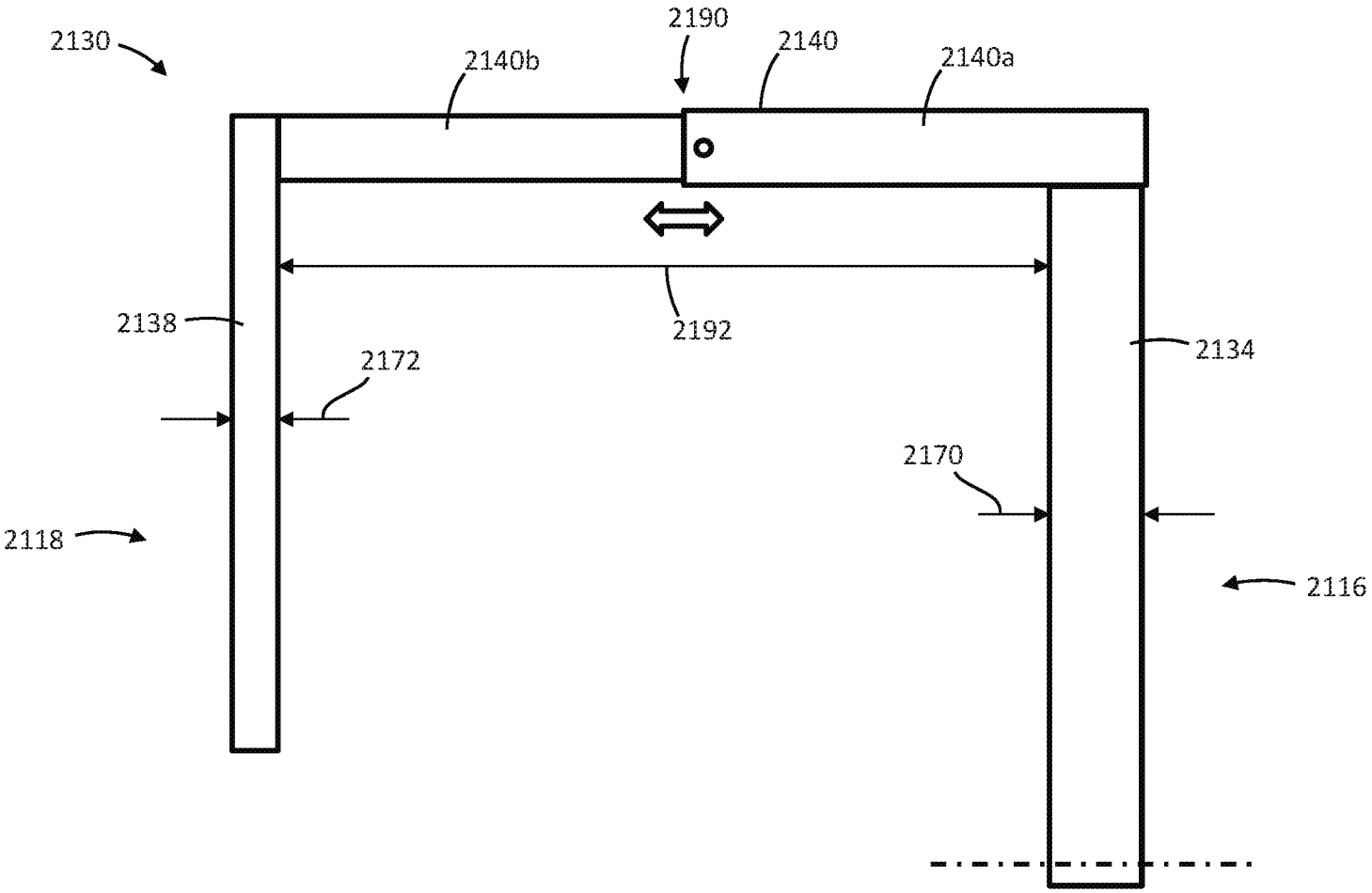
FIG. 8 is a schematic plan view of an example back rest frame for a back rest assembly like that of FIG. 1.

Referring to FIG. 8, another example frame 2130 for a back rest like the back rest 114 is shown schematically. The frame 2130 is similar to the frame 130, and like features are identified with like reference characters, incremented by 2000.

In the example illustrated, the frame 2130 includes a supported first side member 2134 on the supported side 2116 of the back rest, an unsupported second side member 2138 on the unsupported side 2118 of the back rest, and a cross member 2140 joining the first and second side members 2134, 2138.

The first side member 2134 can have a first cross-sectional geometry and the second side member 2138 can have a second cross-sectional geometry different from the first cross-sectional geometry. The first cross-sectional geometry can be selected for providing increased structural support on the supported side 2116 of the back rest. The second cross-sectional geometry can be selected for reducing weight on the unsupported side 2118 of the back rest, and/or for reducing intrusiveness of the second side member 2138 when positioned over the resting surface relative to the first cross-sectional geometry of the first side member 2134.

In the example illustrated, the first side member 2134 comprises a first tube and the first cross-sectional geometry is defined by a first outer diameter 2170. The second side member 2138 comprises a second tube and the second cross-sectional geometry is defined by a second outer diameter 2172. In the example illustrated, the second outer diameter 2172 is less than the first outer diameter 2170 to help reduce weight on the unsupported side 2118 of the back rest, and to help reduce intrusiveness of the second side member 2138 when positioned over the resting surface.

In other examples, the second side member 2138 can have a different cross-sectional geometry, such as, for example, a flat, rectangular cross-sectional geometry, a T-shaped cross-sectional geometry, or a different cross-sectional geometry that can help reduce intrusiveness of the second side member 2138 relative to the first cross-sectional geometry of the first side member 2134. In some examples, padding can be provided over one or more of the first side member 2134, the second side member 2138, and/or the cross member 2140 to help increase comfort.

In some examples, the back rest frame 2130 can have, for example, a generally arched shape. In some examples, the first side member 2134, the second side member 2138, and the cross-member 2140 can be of integral, unitary, one-piece construction.

In some examples, the back rest frame 2130 (or 130) can have a width adjustment mechanism 2190 to vary a lateral side member spacing 2192 between the first and second side members 2134, 2138 (or 134, 138). In the example illustrated in FIG. 8, the cross-member 2140 includes a pair of telescoping cross-member portions 2140*a*, 2140*b* configurable between a locked configuration in which the cross-member portions 2140*a*, 2140*b* are fixed relative to one another, and an unlocked configuration in which the cross-member portions 2140*a*, 2140*b* are slidable relative to one another in the lateral direction to adjust the side member spacing 2192 (and overall width) of the back rest frame 2130. In such examples, the size of the back support surface (e.g. surface 132) can be selected based on the side member spacing 2192, or the back support surface itself can be adjustable to accommodate a change in the side member spacing 2192.

Figure 9:
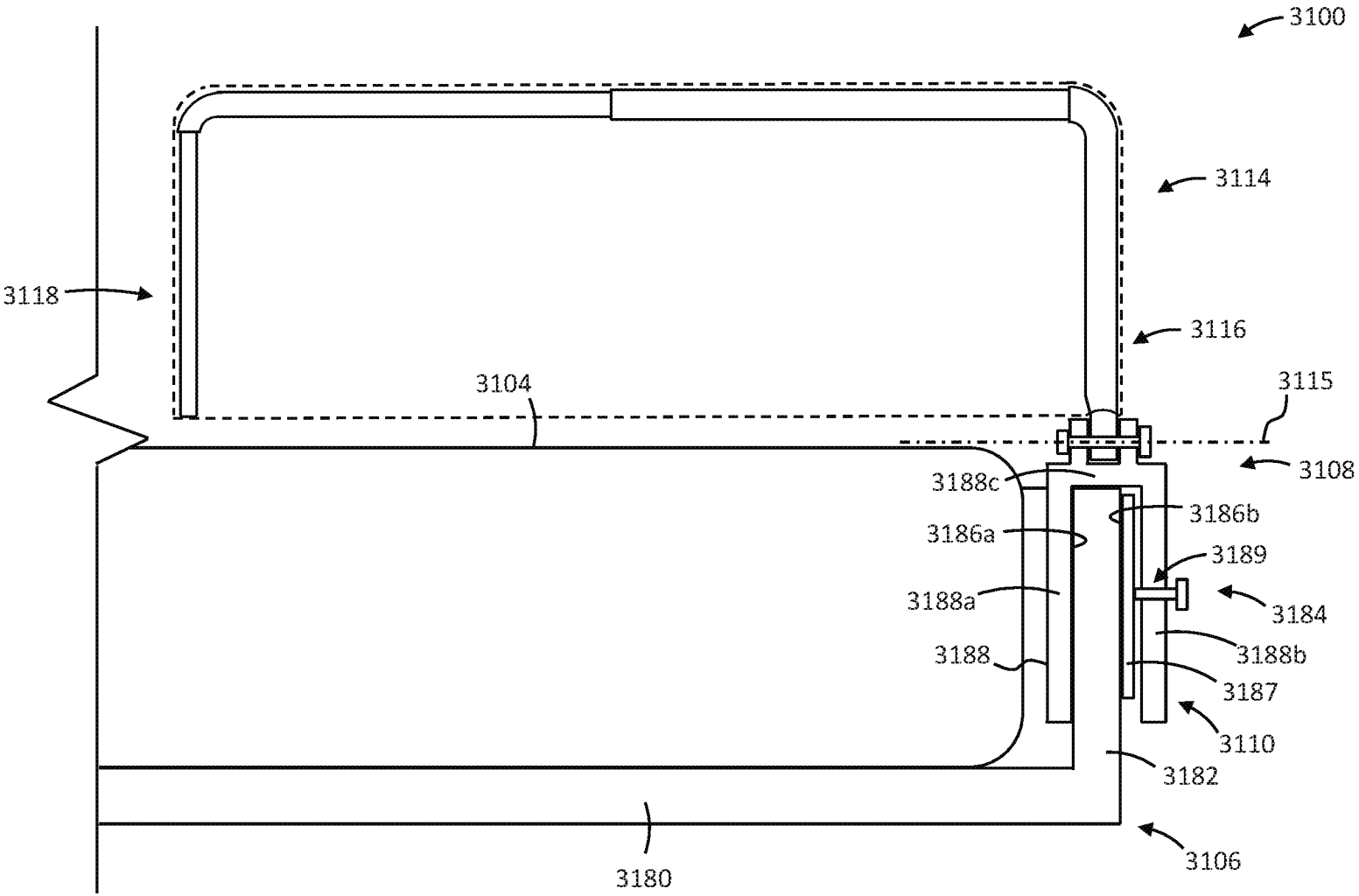
FIG. 9 is a schematic front view of a portion of another example back rest assembly, with the back rest assembly in an inclined configuration.

Referring to FIG. 9, portions of another example back rest assembly 3100 are shown schematically. The back rest assembly 3100 is similar to the back rest assembly 100, and like features are identified with like reference characters, incremented by 1000.

In the example illustrated, the back rest assembly 3100 includes a base assembly 3108 mountable adjacent a resting surface 3104. In the example illustrated, the resting surface 3104 comprises a mattress supported by a bed frame 3106. In the example illustrated, the frame 3106 has a base 3180 supporting the resting surface 3104, and a sidewall 3182 extending upwardly from a periphery of the base 3180 and surrounding the mattress.

In the example illustrated, the back rest assembly 3100 further includes a back rest 3114 having a supported side 3116 pivotably supported by the base assembly 3108 and an unsupported side 3118 spaced laterally apart from the supported side along a lateral axis 3115. When the base assembly 3108 is mounted, the back rest 3114 is positionable over the resting surface 3104 (as shown in FIG. 9) and selectively pivotable about the lateral axis 3115 for adjusting an angular position of the back rest 3114 relative to the resting surface 3104 (e.g. for moving the back rest 3114 between horizontal and inclined positions).

In the example illustrated, the base assembly 3108 comprises a base 3110 mountable to the sidewall 3182 for stabilizing the back rest assembly 100. In the example illustrated, the base 3110 comprises a clamp mechanism 3184 for clamping the base assembly 3108 to the sidewall 3182 to mount the base assembly 3108. In the example illustrated, the clamp mechanism 3184 comprises a first clamping surface 3186*a* positionable against an inner surface of the sidewall 3182 directed toward the mattress and a second clamping surface 3186*b* positionable against an outer surface of the sidewall 3182 opposite the inner surface and movable toward the first clamping surface 3186*a* for clamping the sidewall 3182 between the first and second clamping surfaces 3186*a*, 3186*b*. In the example illustrated, each of the first and second clamping surfaces 3186*a*, 3186*b* can comprise a rubberized surface to facilitate gripping of the sidewall 3182.

In the example illustrated, the clamp mechanism 3184 comprises a clamp frame 3188 having an inner plate 3188*a* comprising the first clamping surface 3186*a*, an outer plate 3188*b* positioned adjacent the outer surface of the sidewall 3182, and a top plate 3188*c* positioned against a top surface of the sidewall 3182 and extending between and connecting the inner and outer plates 3188*a*, 3188*b*. The clamp mechanism 3184 further includes a clamping plate 3187 comprising the second clamping surface 3186*b*. In the example illustrated, the clamping plate 3187 is positioned between the sidewall 3182 and the outer plate 3188*b*, and is adjustably coupled to the outer plate 3188*b* through a threaded connection 3189 permitting adjustment of a spacing between the first and second clamping surfaces 3186*a*, 3186*b* to adjust the clamping force.

The invention claimed is:

1. A back rest assembly for a bed having a horizontal resting surface extending laterally between a bed first side and a bed second side of the bed, the back rest assembly comprising:

a) a base positionable underneath the resting surface for stabilizing the back rest assembly, the base extending laterally between a base first side for positioning on the bed first side and a base second side spaced apart from the base first side in a lateral direction, the base second side for positioning toward the bed second side;

b) a riser supported by the base on the base first side and extending upwardly relative to the base, the riser positioned laterally outboard of the resting surface on the bed first side when the base is underneath the resting surface; and c) a back rest spaced vertically above the base, the back rest having a supported side laterally adjacent to and pivotably supported by the riser and an unsupported side spaced laterally apart from the supported side in the lateral direction toward the base second side, wherein when the base is underneath the resting surface, the back rest is positioned over the resting surface and is pivotable about a lateral axis fixed relative to the riser between a horizontal position in which the back rest is oriented generally horizontally, and at least one inclined position in which the back rest is inclined relative to the resting surface for supporting a user's back, wherein the back rest is spaced apart from the base by a back rest height when in the horizontal position, and the riser includes an adjustment mechanism for selectively raising and lowering the back rest relative to the base to adjust the back rest height, and wherein the riser comprises a post extending along a vertical axis and coupled to the base via the height-adjustment mechanism, and wherein the back rest is carried by the post and the height-adjustment mechanism is configurable between a locked configuration in which the post is vertically fixed relative to the base and an adjustment configuration in which the post is vertically translatable relative to the base for raising and lowering the back rest to adjust the back rest height.

2. A back rest assembly comprising: a) a base for positioning underneath a resting surface; b) a riser supported by and extending upwardly relative to the base, the riser for positioning laterally outboard of the resting surface when the base is underneath the resting surface; and c) a back rest spaced vertically above the base, the back rest having a supported side pivotably supported by the riser and an unsupported side spaced laterally apart from the supported side along a lateral axis, wherein when the base is underneath the resting surface, the back rest is positioned over the resting surface and pivotable about the lateral axis between a first position in which the back rest lies atop and is in direct engagement with the resting surface, and at least one second position in which the back rest is inclined relative to the resting surface for supporting a user's back.

3. The back rest assembly of claim 2, wherein the back rest assembly is free of any load-bearing connection between the base and the unsupported side of the back rest.

4. The back rest assembly of claim 2, wherein the back rest is spaced apart from the base by a back rest height when in the first position, and the riser includes an adjustment mechanism for selectively raising and lowering the back rest relative to the base to adjust the back rest height.

5. The back rest assembly of claim 4, wherein the riser comprises a post extending along a vertical axis and coupled to the base via the height-adjustment mechanism, and wherein the back rest is carried by the post and the height-adjustment mechanism is configurable between a locked configuration in which the post is vertically fixed relative to the base and an adjustment configuration in which the post is vertically translatable relative to the base for raising and lowering the back rest to adjust the back rest height.

6. The back rest assembly of claim 2, further comprising an actuator supported by the riser and operable to urge the back rest from the first position toward the second position.

7. The back rest assembly of claim 6, wherein the actuator includes a linear actuator having an actuator first portion coupled to the riser and an actuator second portion translatable relative to the actuator first portion for urging the back rest from the first position toward the second position.

8. The back rest assembly of claim 6, wherein the back rest is pivotably supported by the riser via a pivot bracket, the pivot bracket pivotably connected to the riser for pivoting about the lateral axis and the back rest mounted to the pivot bracket, the pivot bracket having an actuator connection portion spaced transversely apart from the lateral axis and connected to the actuator, the actuator operable to urge the pivot bracket to pivot about the lateral axis in a forward direction for moving the back rest toward the second position and in a rearward direction circumferentially opposite the forward direction for moving the back rest toward the first position.

9. The back rest assembly of claim 8, wherein the back rest is pivotably mounted to the pivot bracket for pivoting about a bracket axis fixed relative to the pivot bracket, the bracket axis parallel to and spaced apart from the lateral axis.

10. The back rest assembly of claim 6, wherein the back rest assembly is configurable between a first side configuration for mounting the back rest assembly on a first side of the resting surface and a second configuration for mounting the back rest assembly on a second side of the resting surface, wherein when the back rest assembly is in the first side configuration, the base is positionable underneath the resting surface with the riser supporting the back rest on the first side and with the back rest overlying the resting surface and movable away from a head end of the resting surface when urged by the actuator to pivot toward the second position, and when the back rest assembly is in the second side configuration, the base is positionable underneath the resting surface with the riser supporting the back rest on the second side and with the back rest overlying the resting surface and movable away from the head end of the resting surface when urged by the actuator to pivot toward the second position.

11. The back rest assembly of claim 2, further comprising a stop surface limiting pivoting of the backrest in a rearward direction to a stop position, wherein the back rest is free to pivot away from the stop surface in a forward direction opposite the rearward direction, and the stop surface is selectively movable to adjust the stop position.

12. The back rest assembly of claim 2, wherein the unsupported side of the back rest extends between a proximal end positioned toward the lateral axis and a distal end spaced apart from the proximal end away from the lateral axis, and the back rest assembly is free of any load-bearing connectors coupled to the unsupported side of the back rest for supporting the unsupported side of the back rest from below.

13. The back rest assembly of claim 2, further comprising an actuator supported by the riser and operable to urge pivoting of the back rest toward the second position.

14. The back rest assembly of claim 13, wherein the actuator is operable to push a platform for engagement with an underside surface of the supported side of the back rest to urge pivoting of the backrest in a forward direction toward the second position, and the platform limits pivoting of the backrest in the rearward direction, and wherein the back rest is free to pivot away from the platform in the forward direction.

15. A back rest assembly comprising:

a) a base assembly mountable adjacent a resting surface; and b) a back rest having a supported side pivotably supported by the base assembly and an unsupported side spaced laterally apart from the supported side along a lateral axis, and when the base assembly is mounted, the back rest is positionable over the resting surface and selectively pivotable about the lateral axis for adjusting an angular position of the back rest relative to the resting surface, wherein the back rest includes a frame having a supported first side member on the supported side and pivotably supported by the base assembly, an unsupported second side member on the unsupported side and extending generally parallel with the first side member, and a cross member extending laterally between and joining the first and second side members, wherein each of the first side member and the second side member extends between a proximal end adjacent the lateral axis and a distal end spaced apart from the proximal end away from the lateral axis, and wherein the cross member extends laterally between and joins the distal ends of the first and second side members, and the back rest assembly is free of any rigid cross members extending between the first and second side members adjacent the proximal ends.

16. The back rest assembly of claim 15, wherein the base assembly comprises a base positionable underneath the resting surface for mounting the base assembly adjacent the resting surface, and a riser supported by and extending upwardly relative to the base, the riser positionable laterally outboard of the resting surface when the base is underneath the resting surface, and the riser pivotably supporting the supported side of the back rest.

17. The back rest assembly of claim 15, wherein the base assembly comprises a base having a clamp mechanism for clamping the base assembly to a frame supporting the resting surface.

18. The back rest assembly of claim 15, wherein the back rest assembly is free of any load-bearing connection between the base assembly and the unsupported side of the back rest.

19. The back rest assembly of claim 15, wherein the base assembly comprises a height adjustment mechanism for selectively raising and lowering the back rest relative to the resting surface when the base assembly is mounted.

20. The back rest assembly of claim 15, further comprising an actuator operable to urge pivoting of the back rest about the lateral axis.

* * * * *